US007699061B2

(12) United States Patent
Seitert et al.

(10) Patent No.: US 7,699,061 B2
(45) Date of Patent: Apr. 20, 2010

(54) MULTI-COMPONENT FILTER PROVIDING MULTIPLE FLAVOUR ENHANCEMENT

(75) Inventors: Hugues Seitert, Neuchâtel (CH); Ahmed Gawad, Lonay (CH); Levent Lekili, Colombier (CH); Charles Kuersteiner, Jouxtens-Mezery (CH)

(73) Assignee: Philip Morris USA Inc., Richmond, VA (US)

( * ) Notice: Subject to any disclaimer, the term of this patent is extended or adjusted under 35 U.S.C. 154(b) by 429 days.

(21) Appl. No.: 11/882,115

(22) Filed: Jul. 30, 2007

(65) Prior Publication Data

US 2008/0029114 A1 Feb. 7, 2008

(30) Foreign Application Priority Data

Aug. 4, 2006 (EP) ..... 06254102

(51) Int. Cl.
*A24D 3/06* (2006.01)

(52) U.S. Cl. ..... 131/344; 131/336

(58) Field of Classification Search ..... 131/344, 131/334, 345, 336
See application file for complete search history.

(56) References Cited

U.S. PATENT DOCUMENTS

| | | | | |
|---|---|---|---|---|
| 3,858,587 | A | 1/1975 | Cavelli et al. | |
| 3,875,949 | A | 4/1975 | Catanese et al. | |
| 4,281,671 | A | 8/1981 | Bynre et al. | |
| 5,115,823 | A * | 5/1992 | Keritsis | 131/336 |
| 7,074,170 | B2 | 7/2006 | Lanier, Jr. et al. | |
| 2003/0154993 | A1 * | 8/2003 | Paine et al. | 131/341 |

FOREIGN PATENT DOCUMENTS

| | | | |
|---|---|---|---|
| EA | 001553 | B1 | 10/2000 |
| EA | 004840 | B1 | 2/2004 |
| GB | 1329956 | A | 9/1973 |
| RU | 2116040 | C1 | 7/1998 |
| WO | WO84/01272 | A1 | 4/1984 |
| WO | WO 02/069745 | A1 | 9/2002 |

OTHER PUBLICATIONS

Eurasian Search Report dated Oct. 25, 2007 for Eurasian Patent Appln. No. 200701446.
International Search Report and Written Opinion dated Feb. 1, 2008 for PCT/IB2007/003030.
International Preliminary Report on Patentability issued Feb. 10, 2009 for PCT/IB2007/003030.
European Search Report dated Feb. 15, 2007 for EP 06254102.

* cited by examiner

*Primary Examiner*—Carlos Lopez
(74) *Attorney, Agent, or Firm*—Buchanan Ingersoll & Rooney PC

(57) ABSTRACT

A multi-component filter for a smoking article comprises: a mouth end segment; a first flavour release segment comprising plant leaf upstream of the mouth end segment; and a second flavour release segment comprising filtration material and a flavourant upstream of the first flavour release segment. The resistance to draw of the second flavour release segment is greater than the resistance to draw of the first flavour release segment and the resistance to draw of the second flavour release segment is greater than the resistance to draw of the mouth end segment. The multi-component filter preferably further comprises a rod end segment comprising filtration material upstream of the second flavour release segment, which has a lower resistance to draw than the second flavour release segment.

16 Claims, 2 Drawing Sheets

MULTI-COMPONENT FILTER PROVIDING MULTIPLE FLAVOUR ENHANCEMENT

CROSS-REFERENCE TO RELATED APPLICATION

This application claims priority under 35 U.S.C. §119 to European Application No. 06254102.4, filed Aug. 4, 2006, the entire content of which is hereby incorporated by reference.

BACKGROUND

The present invention relates to a multi-component filter for a smoking article and to a smoking article comprising such a multi-component filter.

Filter cigarettes typically comprise a rod of tobacco cut filler surrounded by a paper wrapper and a cylindrical filter aligned in end-to end relationship with the wrapped tobacco rod and attached thereto by tipping paper. Ventilation in the form of circumferential perforations is commonly provided at a location along the filter, to mix the mainstream smoke produced during combustion of the wrapped tobacco rod with ambient air.

In conventional filter cigarettes, the filter usually consists of a plug of cellulose acetate tow wrapped in porous plug wrap. However, filter cigarettes with multi-component filters that comprise two or more segments of filtration material for the removal of particulate and gaseous components of the mainstream smoke are also known. To enhance the flavour of the mainstream smoke produced during combustion of the wrapped tobacco rod, it is also known to provide filter cigarettes with filters that include flavourants.

It would be desirable to provide a multi-component filter for a smoking article such as a cigarette that, in use, provides improved flavour enhancement to mainstream smoke as it is drawn from a rod of smokable material through the filter by a consumer.

SUMMARY

According to the present invention there is provided a multi-component filter for a smoking article comprising: a mouth end segment; a first flavour release segment comprising plant leaf upstream of the mouth end segment; and a second flavour release segment comprising filtration material and a flavourant upstream of the first flavour release segment, wherein the resistance to draw of the second flavour release segment is greater than the resistance to draw of the first flavour release segment and the resistance to draw of the second flavour release segment is greater than the resistance to draw of the mouth end segment.

Throughout the specification, "upstream" and "downstream" are used to describe the relative positions of segments of the multi-component filter of the invention in relation to the direction of mainstream smoke drawn from a rod of smokable material through the multi-component filter during use.

In use, as mainstream smoke is drawn from a rod of smokable material through the multi-component filter, flavour is released into the mainstream smoke by the flavourant in the second flavour release segment. As the mainstream smoke passes downstream from the second flavour release segment through the multi-component filter towards the mouth end segment thereof, additional flavour is released into the mainstream smoke from the plant leaf in the first flavour release segment. Multi-component filters according to the present invention thereby advantageously provide dual flavour enhancement to mainstream smoke drawn therethrough.

Preferably, the external diameter of multi-component filters according to the invention is between about 5 mm and about 8.5 mm, more preferably about 7.8 mm.

Preferably, the overall length of multi-component filters according to the invention is between about 24 mm and about 48 mm, more preferably about 34 mm.

Preferably, the overall encapsulated resistance to draw (RTD) of multi-component filters according to the invention is between about 100 mm WG (water gauge) and about 180 mm WG, more preferably about 140 mm WG as measured in accordance with ISO 6565:2002.

Preferably, the mouth end segment has substantially no particulate phase filtration efficiency or very low particulate phase filtration efficiency. For example, the mouth end segment may comprise cellulosic material, such as cellulose acetate tow, or other suitable fibrous material of low filtration efficiency. Alternatively, the mouth end segment may consist of a hollow tube or recess located at the mouth end of the multi-component filter that has substantially no filtration efficiency. Where the mouth end segment of a multi-component filter according to the present invention is a hollow tube or recess, the mouth end segment may be formed when the multi-component filter is attached to a rod of smokable material by, for example, tipping paper to form a smoking article.

Preferably, the mouth end segment has a resistance to draw of about 20 mm WG or less as measured in accordance with ISO 6565:2002.

Preferably, the length of the mouth end segment is between about 3 mm and about 12 mm, more preferably between about 6 mm and about 8 mm.

Where the mouth end segment comprises a hollow tube or recess, the length of the mouth end segment is preferably between about 3 mm and about 4 mm.

The mouth end segment is used to balance the overall resistance to draw of the multi-component filter of the present invention in order to achieve a desired overall resistance to draw for a smoking article comprising the multi-component filter. For example, where the mouth end segment comprises a plug of cellulose acetate tow, the denier per filament and total denier of the tow may be selected in order to achieve a desired overall resistance to draw for the multi-component filter. Preferably, where the mouth end segment comprises a plug of cellulose acetate tow, the cellulose acetate tow has a denier per filament of about 5 or more.

The first flavour release segment may include any plant leaf that is capable of releasing flavour into mainstream smoke drawn through the multi-component filter.

Preferably, the plant leaf is shredded, cut or otherwise reduced in size. More preferably, the plant leaf is finely cut. Most preferably, the plant leaf has a cut width of about 0.4 mm.

Preferably the plant leaf is dried. Preferably, the moisture content of the plant leaf is about 15% or less by weight.

The first flavour release segment may include leaf from one or more plants. For example, the first flavour release segment may comprise tobacco or herb plant leaf or mixtures thereof. Preferably, the first flavour release segment includes leaf from one or more plants having leaves that are about 1 cm in width and 3 cm in length when dried.

Preferably, the first flavour release segment comprises plant leaf selected from the group consisting of tobacco, green tea, peppermint, laurel, eucalyptus, basil, sage, verbena and tarragon. More preferably, the first flavour release segment comprises tobacco, most preferably oriental tobacco.

Preferably, the length of the first flavour release segment is between about 6 mm and about 12 mm, more preferably between about 6 mm and about 10 mm.

The first flavour release segment may include plant leaf to which casing comprising, for example, sugars or humectants has been applied. The second flavour release segment may include any flavourant capable of releasing flavour into mainstream smoke drawn through the multi-component filter. Preferably, the second flavour release segment comprises a liquid flavourant.

Preferably, the second flavour release segment comprises fibrous filtration material and a liquid flavourant, more preferably fibrous cellulosic filtration material and a liquid flavourant, most preferably cellulose acetate tow and a liquid flavourant.

The flavourant may be natural or synthetic and the second flavour release segment may comprise one or more different flavourants. For example, the second flavour release segment may comprise one or more essential oils, oleoresins, absolutes, fruit concentrates, fruit extracts and distillates.

Second flavour release segments of multi-component filters according to the present invention may comprise flavourants including one or more flavour ingredients to create a certain flavour type. Flavourants and flavour types that may be included in the second flavour release segment include, but are not limited to, coffee, tea, spices (such as cinnamon, clove and ginger), cocoa, vanilla, spearmint, peppermint, fruit flavourants (such as blueberry, cranberry, orange, peach, and strawberry), chocolate, menthol, eucalyptus, geranium extract, linalool and citrus.

The second flavour release segment may comprise a plug of cellulose acetate tow impregnated with a liquid flavourant. The liquid flavourant may be applied directly into a stream of cellulose acetate tow during manufacture of the second flavour release segment, either by spraying the liquid flavourant under pressure onto the tow or by injecting the liquid flavourant into the tow.

In a preferred embodiment of the invention, the second flavour release segment comprises a plug of filtration material including one or more threads impregnated with liquid flavourant. The one or more threads may be formed from any suitable materials capable of absorbing liquid flavourant including, but not limited to, cotton, cellulose acetate, rayon, or other textile or non-textile materials. Preferably the one or more threads are formed of cotton yarn or cellulose acetate yarn.

Filter plugs comprising flavourant bearing threads suitable for use in multi-component filters according to the present invention, and methods and apparatus for forming such plugs, are described in U.S. Pat. Nos. 4,281,671 and 7,074,170 and are available from the American Filtrona Company, Richmond, Va., USA.

Preferably, the second flavour release segment comprises a plug of filtration material including a single thread impregnated with liquid flavourant. The second flavour release segment may, however, comprise a plug of filtration material including more than one flavourant-bearing thread. Each thread may be impregnated with more than one liquid flavourant. In addition, where the second flavour release segment comprises a plug of filtration material including two or more flavourant-bearing threads, the threads may be impregnated with the same or different liquid flavourants.

In a particularly preferred embodiment, the second flavour release segment comprises a plug of cellulose acetate tow including a single, centrally located, axial thread impregnated with liquid flavourant.

As mainstream smoke is drawn from the lit end of a rod of smokable material through a filter attached to the rod into a consumer's mouth, the mainstream smoke cools. Location of the second flavour release segment upstream of the first flavour release segment in multi-component filters according to the present invention helps to maximise flavour enhancement by the second flavour release segment of mainstream smoke drawn through the filter.

Furthermore, in use, the increased resistance to draw of the second flavour release segment compared to the first flavour release segment and the mouth end segment also helps to maximise flavour enhancement by the second flavour release segment of mainstream smoke drawn from a rod of smokable material through the filter.

Preferably, the second flavour release segment has a resistance to draw (RTD) of between about 40 mm WG and about 100 mm WG, more preferably a resistance to draw of about 70 mm WG as measured in accordance with ISO 6565:2002.

Preferably, the length of the second flavour release segment is between about 6 mm and about 12 mm, more preferably between about 6 mm and about 10 mm.

Multi-component filters according to the invention preferably further comprise a rod end segment comprising filtration material upstream of the second flavour release segment, wherein the resistance to draw of the second flavour release segment is greater than the resistance to draw of the rod end segment. The inclusion of a rod end segment comprising filtration material provides additional filtration efficiency.

As previously described, where the mouth end segment of a multi-component filter according to the present invention is a hollow tube or recess, the mouth end segment may be formed when the multi-component filter is attached to a rod of smokable material by, for example, tipping paper to form a smoking article. Prior to incorporation into a smoking article, multi-component filters according to the present invention may, therefore, comprise: a first flavour release segment comprising plant leaf; a second flavour release segment comprising filtration material and a flavourant upstream of the first flavour release segment; and a rod end segment comprising filtration material upstream of the second flavour release segment, wherein the resistance to draw of the second flavour release segment is greater than the resistance to draw of the first flavour release segment and the resistance to draw of the second flavour release segment is greater than the resistance to draw of the rod end segment.

Preferably, the length of the rod end segment is between about 6 mm and about 12 mm, more preferably between about 6 mm and about 8 mm.

The rod end segment may comprise any suitable known filtration materials including, but not limited to, cellulose acetate and paper. Preferably the rod end segment comprises fibrous filtration material, more preferably cellulosic filtration material, most preferably cellulose acetate tow.

Preferably, the rod end segment further comprises at least one sorbent capable of removing at least one gas phase constituent from mainstream smoke drawn through the filter. Preferably, the at least one sorbent is selected from the group consisting of activated carbon, activated alumina, zeolites, molecular sieves and silica gel. Most preferably, the sorbent is activated carbon.

If desired, the rod end segment may further comprise a flavourant. For example, the rod end segment may comprise a mesoporous sorbent having pores of between about 2 nm and about 50 nm in diameter, which is sprayed or otherwise impregnated with a liquid flavourant so that the rod end segment is adapted to not only remove at least one gas phase constituent from mainstream smoke drawn from a rod of smokable material through the multi-component filter, but also to release flavour into the mainstream smoke.

The inclusion of a rod end segment comprising a fibrous filtration material and at least one sorbent is particularly preferred in multi-component filters according to the invention for use in ultra low tar filter cigarettes having a total tar delivery of about 3 mg or less.

In a particularly preferred embodiment of the invention, the multi-component filter includes a rod end segment comprising a plug of cellulose acetate tow loaded with high surface area activated carbon.

It will be appreciated, however, that in multi-component filters according to the invention for use in filter cigarettes having a higher total tar delivery, for example a total tar delivery of about 6 mg or higher, the rod end segment may be omitted.

Multi-component filters according to the present invention may further comprise one or more additional flavour release segments of either the same general construction as the first flavour release segment or the second flavour release segment.

Preferably, multi-component filters according to the invention comprise a maximum of five segments.

Preferably, multi-component filters according to the invention comprise a maximum of three flavour release segments.

Multi-component filters according to the invention may be produced by forming separate continuous rods comprising multiple units of each segment of the filter and then combining these separate rods in a known manner in one or more stages to form a continuous filter rod comprising multiple units of the multiple-component filter. The continuous filter rod may then be subsequently severed at regular intervals by a cutting mechanism to yield a succession of discrete multi-component filters according to the invention.

According to the invention there is also provided a smoking article comprising a wrapped rod of smokable material and a multi-component filter according to the invention attached to the rod of smokable material by tipping paper.

Preferably, the overall length of the smoking article is between about 70 mm and about 128 mm, more preferably about 84 mm.

Smoking articles according to the present invention preferably further comprise at least one circumferential row of perforations at a location along the multi-component filter in order to ventilate mainstream smoke drawn through the multi-component filter from the rod of smokable material by a consumer.

Preferably, the at least one circumferential row of perforations is located at least 12 mm from the mouth end of the multi-component filter.

Preferably, smoking articles according to the invention have a ventilation of between about 40% and about 80%, more preferably a ventilation of about 70% as measured in accordance with ISO 9512:2002.

Preferably, ventilated smoking articles according to the present invention have a resistance to draw (RTD) of between about 60 mm WG and about 110 mm WG as measured in accordance with ISO 6565:2002.

Preferably, smoking articles according to the present invention have a total nicotine free dry particulate matter (NFDPM) or "tar" delivery of between about 1 mg and about 6 mg, more preferably a total tar delivery of between about 1 mg and about 3 mg.

Preferably, the smokable material is tobacco cut filler, more preferably tobacco cut filler comprising less than about 25% by weight expanded tobacco, most preferably tobacco cut filler comprising about 15% or less by weight expanded tobacco.

Preferably, the rod of smokable material is wrapped in cigarette paper having a burning agent content, for example a citrate content, of greater than about 1% by weight.

BRIEF DESCRIPTION OF THE DRAWINGS

The invention will be further described, by way of example only, with reference to the accompanying drawings in which.

The cigarettes according to the first, second and third embodiments of the invention shown in FIGS. 1, 2 and 3, respectively, have several components in common; these components have been given the same reference numerals throughout.

DETAILED DESCRIPTION

Figure 1:
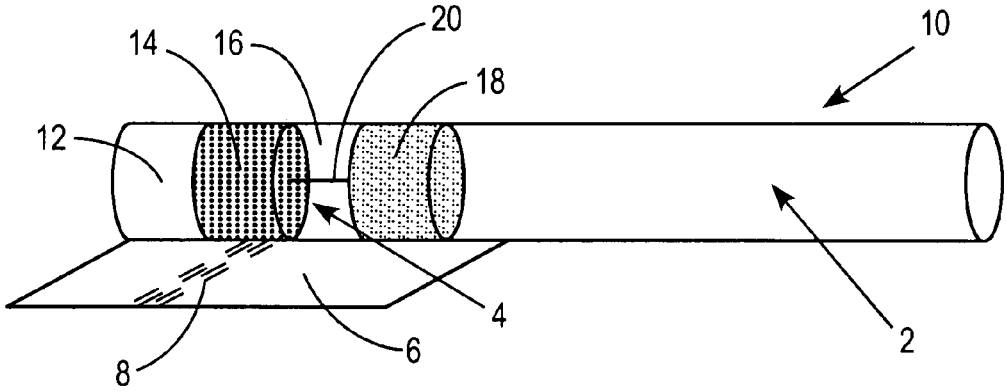
FIG. 1 shows a side view of a filter cigarette comprising a tobacco rod and a multi-component filter according to a first preferred embodiment of the invention with portions thereof broken away to illustrate interior details of the multi-component filter.

Each cigarette generally comprises an elongate, cylindrical wrapped tobacco rod 2 attached at one end to an axially aligned, elongate, cylindrical, multi-component filter 4. The wrapped tobacco rod 2 and the multi-component filter 4 are joined in a conventional manner by tipping paper 6, which circumscribes the entire length of the multi-component filter and an adjacent portion of the wrapped tobacco rod 2. To ventilate mainstream smoke produced during combustion of the wrapped tobacco rod 4 with ambient air, a plurality of annular perforations 8 are provided through the tipping paper 6 at a location along the multi-component filter 4.

The multi-component filter 4 of the cigarette 10 according to the preferred embodiment of the invention shown in FIG. 1 includes four segments in abutting end-to-end relationship: a mouth end segment 12, distant from the wrapped tobacco rod 2; a first flavour release segment 14, located upstream of the mouth end segment 12; a second flavour release segment 16, located upstream of the first flavour release segment 14; and a rod end segment 18, located upstream of the second flavour release segment 16, which is adjacent to and abuts the wrapped tobacco rod 2.

The mouth end segment 12 comprises a plug of cellulose acetate tow of low filtration efficiency.

The first flavour release segment 14 comprises densely packed fine cut tobacco.

The second flavour release segment 16 comprises a plug of cellulose acetate tow of high filtration efficiency and a central cotton thread 20 loaded with liquid flavourant that extends axially through the plug of cellulose acetate tow parallel to the longitudinal axis of the cigarette 10.

The rod end segment 18 comprises a plug of cellulose acetate tow of medium to low filtration efficiency loaded with activated carbon.

During smoking of the cigarette 10, mainstream smoke is drawn downstream from the lit end of the wrapped tobacco rod through the multi-component filter 4 by the consumer. As the mainstream smoke enters the multi-component filter 4 it passes through the rod end segment 18 of the multi-component filter 4, where the medium to low filtration efficiency cellulose acetate tow partially filters out particulate phase components of the smoke and the activated carbon distributed amongst the cellulose acetate tow filters out gas phase components of the smoke. The mainstream smoke then passes downstream through the second flavour release segment 16, where the high filtration efficiency cellulose acetate tow also partially filters out particulate phase components of the smoke and flavour is released into the mainstream smoke from the flavourant loaded onto the cotton thread 20. Having passed through the second flavour release segment 16, the mainstream smoke enters the first flavour release segment 14, where further flavour is released into the smoke from the densely packed finely cut tobacco. Finally, the smoke passes through the mouth end segment 12 of the multi-component filter 4 into the consumer's mouth.

The high filtration efficiency of the cellulose acetate tow in the second flavour release segment 16, which has the highest resistance to draw of the four segments in the multi-component filter 4, maximises filtration of particulate phase components of the mainstream smoke, while the activated carbon distributed amongst the cellulose acetate tow of the rod end segment 18 maximises filtration of gas phase components of the mainstream smoke. At the same time, the first flavour release segment 14 and the second flavour release segment 16 of the multi-component filter 4 also provide dual flavour enhancement to the mainstream smoke, while the mouth end segment 12 balances the overall resistance to draw of the multi-component filter 4 and hence the cigarette 10.

Figure 2:
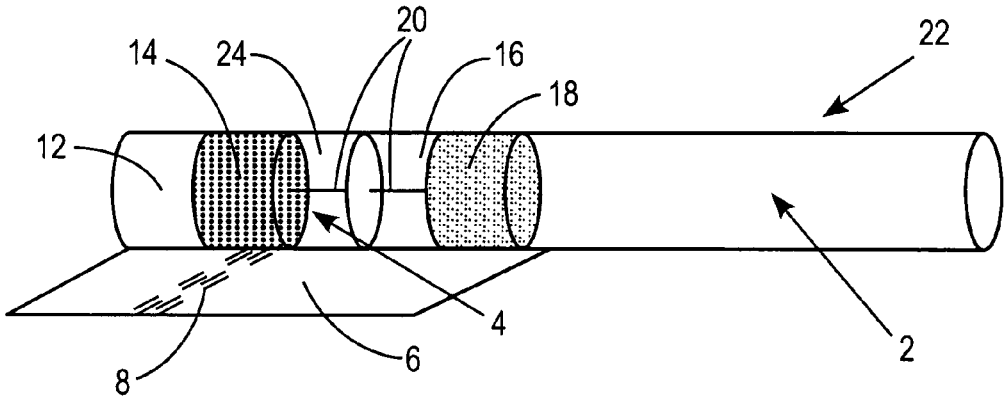
FIG. 2 shows a side view of a filter cigarette comprising a tobacco rod and a multi-component filter according to a second embodiment of the invention with portions thereof broken away to illustrate interior details of the multi-component filter.

The cigarette 22 according to the second embodiment of the invention shown in FIG. 2 has a multi-component filter 4 that includes five segments in abutting end-to-end relationship.

The multi-component filter 4 comprises a mouth end segment 12, a first flavour release segment 14, a second flavour release segment 16 and a rod end segment 18 of the same construction previously described above for the cigarette 10 shown in FIG. 1. In addition, the multi-component filter 4 includes a third flavour release segment 24 located upstream of the first flavour release segment 14 and downstream of the second flavour release segment 16. The third flavour release segment 24 is of similar construction to the second flavour release segment 16, but comprises a plug of cellulose acetate tow of low, rather than high, filtration efficiency and a central cotton thread 20 loaded with a second, different, liquid flavourant that extends axially through the plug of cellulose acetate tow parallel to the longitudinal axis of the cigarette 22.

In use, as mainstream smoke is drawn from the wrapped tobacco rod 2 through the multi-component filter 4, flavour is released from the second flavourant loaded onto the cotton thread 20 into the mainstream smoke as it passes through the third flavour release segment 24. The multi-component filter 4 according to the second embodiment of the invention shown in FIG. 2 thus provides triple flavour enhancement to the mainstream smoke as it is drawn through the filter 4.

Figure 3:
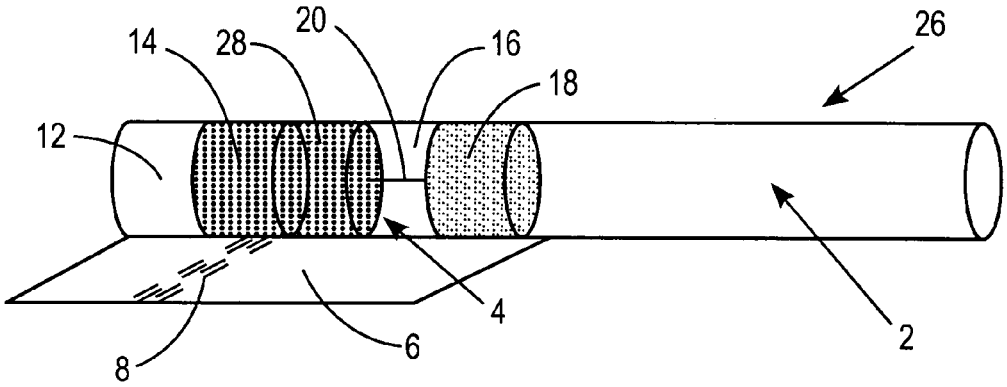
FIG. 3 shows a side view of a filter cigarette comprising a tobacco rod and a multi-component filter according to a third embodiment of the invention with portions thereof broken away to illustrate interior details of the multi-component filter.

The cigarette 26 according to the third embodiment of the invention shown in FIG. 3 also has a multi-component filter 4 that includes five segments in abutting end-to-end relationship.

Once again, the multi-component filter 4 comprises a mouth end segment 12, a first flavour release segment 14, a second flavour release segment 16 and a rod end segment 18 of the same construction previously described above for the cigarette 10 shown in FIG. 1. In addition, the multi-component filter 4 includes a third flavour release segment 28 located upstream of the first flavour release segment 14 and downstream of the second flavour release segment. In this embodiment the third flavour release segment is of similar construction to the first flavour release segment 14, but comprises a second, different, densely packed fine cut plant leaf, such as green tea.

In use, as mainstream smoke is drawn from the wrapped tobacco rod 2 through the multi-component filter 4, flavour is released from the second plant leaf into the mainstream smoke as it passes through the third flavour release segment 28. The multi-component filter 4 according to the third embodiment of the invention shown in FIG. 3 thus also provides triple flavour enhancement to the mainstream smoke as it is drawn through the filter 4.

To form the cigarettes 10, 22, 26 according to the first, second and third embodiments of the inventions shown in FIGS. 1, 2 and 3, respectively, the multi-component filters 4 are produced and then joined to the wrapped tobacco rods 2, which are produced in a conventional manner, by tipping paper 6 using known filter cigarette making equipment.

To produce each multi-component filter 4, separate continuous rods comprising multiple units of each segment 12, 14, 16, 18, 24, 28 of the multi-component filter 4 are produced in a known manner and then combined to form a continuous filter rod comprising multiple units of the multiple-component filter 4. The continuous filter rod is then severed at regular intervals by a cutting mechanism to yield a succession of discrete multi-component filters 4.

Figure 4:
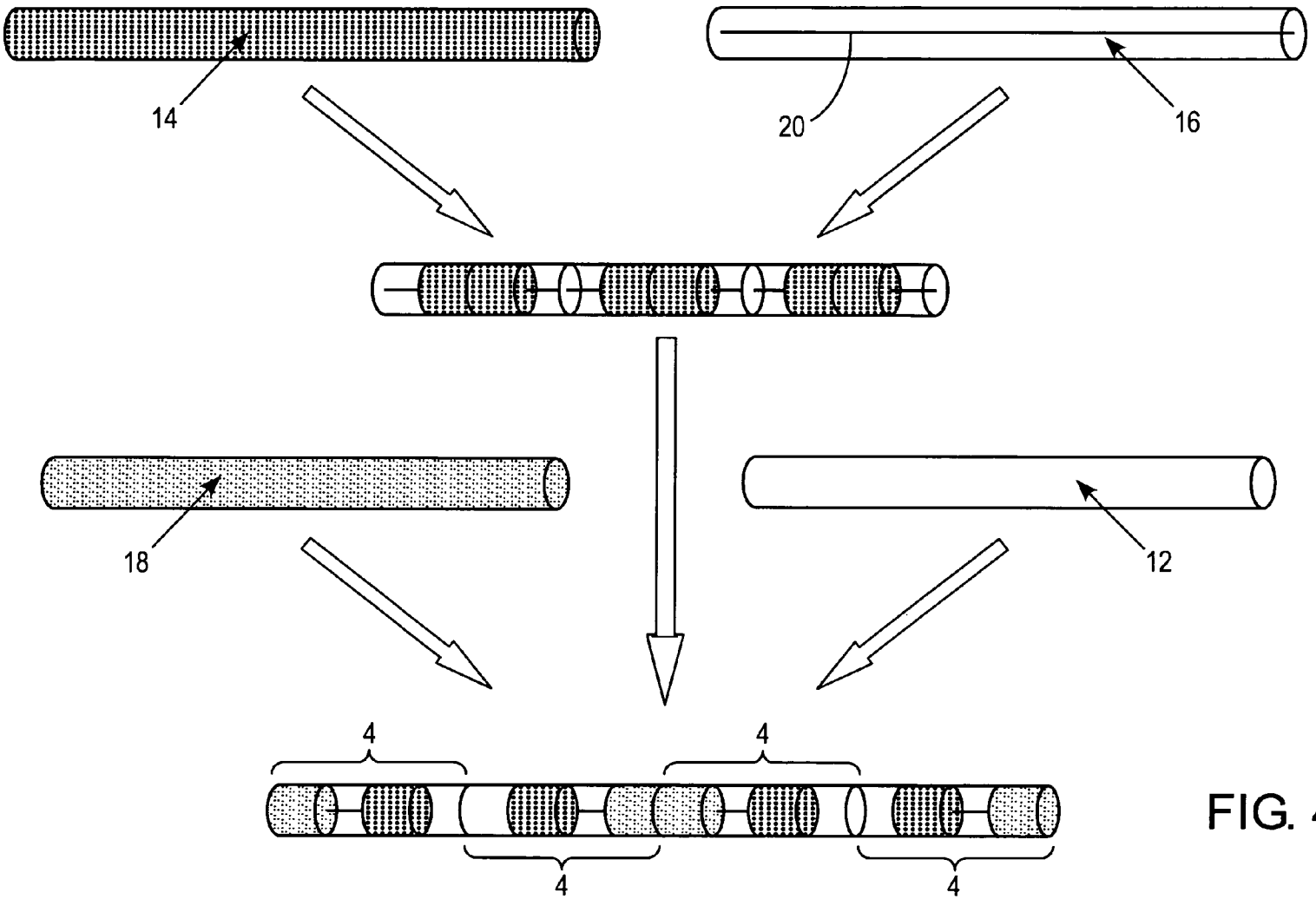
FIG. 4 shows a two-stage combining process for forming a multi-component filter according to the first preferred embodiment of the invention shown in FIG. 1.

FIG. 4 illustrates a two-stage combining process for forming a multi-component filter 4 according to the first preferred embodiment of the invention shown in FIG. 1. As shown in FIG. 4, in the first stage of the process, two separate rods comprising multiple units of the first flavour release segment 14 and the second flavour release segment 16, each wrapped in a first web of porous plug wrap, are combined to form a stream of aligned alternating pairs of first flavour release segments 14 and second flavour release segments 16, which is then wrapped in a second web of porous plug wrap.

In the second stage, the wrapped alternating pairs of first flavour release segments 14 and second flavour release segments 16 are combined with two separate rods comprising multiple units of the rod end segment 18 and the mouth end segment 12, each wrapped in a first web of porous plug wrap, and then wrapped in a third web of porous plug wrap to produce a filter rod comprising multiple units of the multiple-component filter 4.

The separate rods comprising multiple units of the first flavour release segment 14, second flavour release segment 16, rod end segment 18 and mouth end segment 12 could alternatively be combined in one stage using a single combiner.

EXAMPLE

A filter cigarette according to the first embodiment of the invention having the dimensions and properties given in Table 1 below was produced by the two-stage combining process illustrated in FIG. 4.

TABLE 1

| | Multi-component filter | | | | Tobacco rod |
|---|---|---|---|---|---|
| | | | | | 85% American blend<br>15% expanded tobacco |
| Encapsulated RTD (mm WG) | 140 | | | | |
| Ventilation (%) | 70 | | | | — |
| Length (mm) | 34 | | | | 50 |
| External Diameter (mm) | 7.8 | | | | 7.9 |
| | Segment: | | | | |
| | Mouth end segment | First flavour release segment | Second flavour release segment | Rod end segment | — |
| Length (mm) | 7 | 10 | 10 | 7 | — |
| Diameter (mm) | 7.6 | 7.5 | 7.5 | 7.6 | — |
| RTD (mm WG) | 10 | 29 | 71 | 7 | — |
| Cellulose acetate: denier per filament | 8.0 | — | 1.5 | 3.0 | — |
| Cellulose acetate: total denier | 28000 | — | 46000 | 35000 | — |
| Cellulose acetate: weight (mg) | 31.76 | — | 57.5 | 37.94 | — |
| Triacetin (mg) | 2.2 (7%) | — | 4.0 (7%) | 2.3 (6%) | — |
| Dry Tobacco (mg) | — | 155.8 | — | — | — |
| Oven Volatiles (mg) | — | 20.3 (13%) | — | — | — |
| Cotton thread (mg) | — | — | 1.5 | — | — |
| Carbon (mg) | — | — | — | 22.2 | — |
| First plug wrap porosity ($cm^3/min \cdot cm^2$) | 12000 | 24000 | 12000 | 12000 | — |
| Second plug wrap porosity ($cm^3/min \cdot cm^2$) | 24000 | | | | — |
| Third plug wrap porosity ($cm^3/min \cdot cm^2$) | 24000 | | | | — |
| NFDPM (mg) | 1 | | | | |
| Nicotine (mg) | 0.1 | | | | |

While the invention has been exemplified above with reference to filter cigarettes comprising multi-component filters including a rod end segment comprising a plug of cellulose acetate tow loaded with activated carbon, it will be appreciated that multi-component filters according to the present invention may be used in cigarettes and other smoking articles with or without a segment comprising a sorbent or fibrous filtration material upstream of the second flavour release segment.

It will also be appreciated that the type and quantity of plant leaf in the first flavour release segment and the type and quantity of flavourant in the second flavour release segment of multi-component filters according to the present invention may be varied in order to provide a desired rate of delivery of flavour to mainstream smoke drawn from a rod of smokable material through the filter by a consumer in use.

As described above, in use, the first flavour release segment and second flavour release segment of multi-component filters according to the present invention can each release desired flavourants into mainstream smoke passing through the multi-component filter, thereby advantageously providing dual flavour enhancement to the mainstream smoke. Through the provision of dual flavour enhancement to mainstream smoke drawn therethrough, multi-component filters according to the invention advantageously enable the manufacture of filter cigarettes and other filtered smoking articles that are flavourful, whilst still achieving significant reductions in particulate phase and gas phase components of the mainstream smoke and an acceptable overall resistance to draw.

The invention claimed is:

1. A multi-component filter for a smoking article comprising:

a mouth end segment;

a first flavour release segment comprising plant leaf upstream of the mouth end segment; and a second flavour release segment comprising filtration material and a flavourant upstream of the first flavour release segment, wherein the resistance to draw of the second flavour release segment is greater than the resistance to draw of the first flavour release segment and the resistance to draw of the second flavour release segment is greater than the resistance to draw of mouth end segment.

2. A multi-component filter according to claim 1, wherein the first flavour release segment comprises tobacco.

3. A multi-component filter according to claim 1, wherein the second flavour release segment comprises cellulose acetate tow.

4. A multi-component filter according to claim 3, wherein the second flavour release segment comprises a plug of cellulose acetate tow impregnated with a liquid flavourant.

5. A multi-component filter according to claim 1, wherein the second flavour release segment comprises a plug of cellulose acetate including one or more threads impregnated with liquid flavourant.

6. A multi-component filter according to claim 1, further comprising:

a rod end segment comprising filtration material upstream of the second flavour release segment, wherein the resistance to draw of the second flavour release segment is greater than the resistance to draw of the rod end segment.

7. A multi-component filter according to claim 6, wherein the rod end segment comprises cellulose acetate tow.

8. A multi-component filter according to claim 6, wherein the rod end segment comprises paper.

9. A multi-component filter according to claim 6, wherein the rod end segment further comprises at least one sorbent capable of removing gas phase constituents from mainstream smoke drawn through the filter.

10. A multi-component filter according to claim 9, wherein the at least one sorbent is selected from the group consisting of activated carbon, activated alumina, zeolites, molecular sieves and silica gel.

11. A multi-component filter according to claim 1, wherein the mouth end segment comprises a filtration material.

12. A multi-component filter according to claim 11, wherein the mouth end segment comprises cellulose acetate tow.

13. A smoking article comprising:

a wrapped rod of smokable material; and a multi-component filter according to claim 1 attached to the rod of smokable material by tipping paper.

14. A smoking article according to claim 13, wherein the mouth end segment of the multi-component filter is a hollow tube or recess.

15. A smoking article according to claim 13, further comprising at least one circumferential row of perforations at a location along the multi-component filter.

16. A smoking article according to claim 15, wherein the at least one circumferential row of perforations is located at least 12 mm from the mouth end of the multi-component filter.

* * * * *